US005205275A

United States Patent [19]

Chang

[11] Patent Number: 5,205,275

[45] Date of Patent: Apr. 27, 1993

[54] GAS OVEN WITH OXYGEN SUPPLY MEANS

[76] Inventor: Che-Yuan Chang, c/o Hung Hsing Patent Service Center P.O. Box 55-1670, Taipei, Taiwan

[21] Appl. No.: 794,924

[22] Filed: Nov. 20, 1991

[51] Int. Cl.[5] ..... F24G 3/00

[52] U.S. Cl. ..... 126/39 R; 126/39 R

[58] Field of Search ..... 126/39 R, 39 N; 251/304, 309, 310

[56] References Cited

U.S. PATENT DOCUMENTS 1,933,177 10/1933 Kindl ..... 126/42

2,250,356 7/1941 Brumbaugh ..... 126/42

2,746,533 5/1956 Seaman ..... 126/39 N

*Primary Examiner*—Larry Jones

[57] ABSTRACT

A gas oven includes a gas valve having a rotor plug rotatably held within a valve body of the gas valve, an oxygen supply system fluidically connected with the gas valve for directing oxygen into the valve for adjusting an oxygen stream flowing into a gas stream through the valve for helping a complete gas combustion in the gas oven to prevent the production of poisonous carbon.

6 Claims, 5 Drawing Sheets

GAS OVEN WITH OXYGEN SUPPLY MEANS

BACKGROUND OF THE INVENTION

A conventional gas oven for burning liquid petroleam gas or natural gas such as for family cooking purpose may include a gas valve means as shown in FIGS. 1, 1A, 2 and 2A.

The gas valve means includes a valve body 10 having a gas inlet port 12 vertically formed in a gas tube adapter 13 for directing fuel gas into the port 12 (direction G), a rotor plug hole 11 horizontally formed in the valve body 10 perpendicularly communicating the gas inlet port 12 for rotatably engaging a rotor plug 20 in the hole 11, and a rotating knob 30 secured with the rotor plug 20 rotatably mounted on the gas oven (not shown) for operating the rotor plug 20 for adjusting gas flow rate to a burning nozzle of the oven. The plug 20 normally seals the gas inlet port 12 for closing the gas valve.

The rotor plug 20 is formed with a central longitudinal hole 21 about a longitudinal axis 210 of the plug 20, a large gas inlet opening 211 radially formed through a cross section of the plug 20 perpendicularly intersecting and communicating the central longitudinal hole 21 having a large gas outlet opening 213 formed in an opposite end of the inlet opening 211 on a perimeter of the plug 20 communicating with a first gas passage 113 formed in the valve body 10 to be finally connected with an outer large gas nozzle 115 of a gas burner, a small gas inlet opening 212 radially formed in the plug 20 to be angularly separated from the large opening 211 along a cross sectional plane perpendicular to the longitudinal axis 210 and communicating with the central longitudinal hole 21 and communicating a second gas passage 112 formed in the valve body 10 to be finally connected with an inner small gas nozzle 114 of the gas burner 114, a pilot gas outlet opening 214 formed in an outer portion of the plug 20 communicating with a pilot gas passage 111, 111*a* formed in the valve body 10 to be finally communicated with a pilot gas nozzle 105 for discharging pilot gas to be ignited by an igniting means 14 secured to the valve body 10.

When the knob 30 is rotated to rotate the plug 20 to match the large opening 211 with the gas inlet port 12, the gas (fuel gas) will be directed through the opening 211, the central hole 21 to respectively direct gas to the nozzles 105, 114 and 115, in which the pilot gas is first ignited at nozzle 105 by the igniting means 14 to start the burning of the large nozzle 115 and the small nozzle 114, both nozzles 115, 114 forming an outer-ring gas burner and an inner-ring gas burner (not shown) for cooking or heating purpose for the gas oven. Two air adjusting means 40 are provided on the two nozzles 115, 114 for adjusting the primary air for helping combustion of the gas.

The rotor plug 20 includes a plug portion having the central longitudinal hole 21 formed therein and a stem 22 secured with the rotating knob 30. A sealing member (not shown) may be provided in the stem to prevent gas leakage from the stem if being made as a hollow stem as shown in the figures.

Such a conventional gas oven may sometimes cause an incomplete combustion of the gas, if for instance the gas oven is operated for burning the gas in a closed room or kitchen, thereby producing carbon monoxide which is poisonous and hazardous to human life and causing coking or accumulation of carbon black on the utensils due to the incomplete combustion of the gas.

The present inventor has found the deflects of a conventional gas oven and invented the present invention having a supply of combustion aid for helping a complete gas combustion of a gas oven.

SUMMARY OF THE INVENTION

The object of the present invention is to provide a gas oven including a gas valve having a rotor plug rotatably held within a valve body of the gas valve, an oxygen supply system fluidically connected with the gas valve for directing oxygen into the valve for adjusting an oxygen stream flowing into a gas stream through the valve for helping a complete gas combustion in the gas oven to prevent the production of poisonous carbon monoxide.

DETAILED DESCRIPTION

Figure 1A:
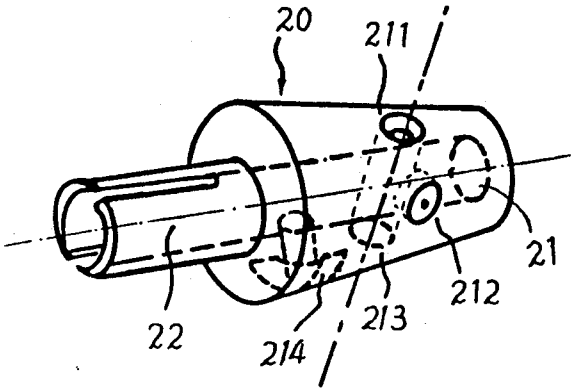
PRIOR ART FIG. 1A
FIG. 1A is an enlarged view of the rotor plug of the conventional gas valve.
Figure 1:
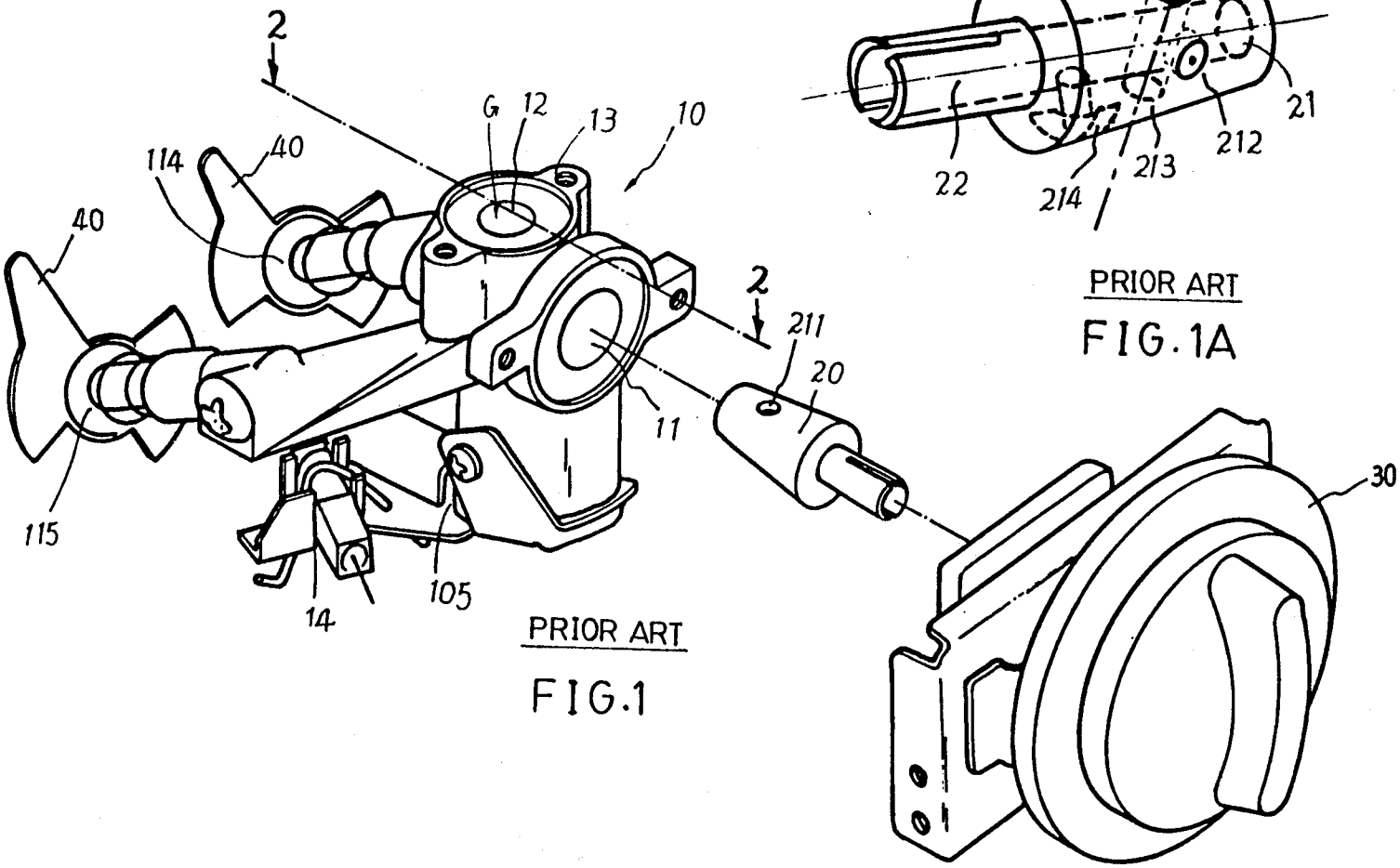
PRIOR ART FIG. 1
FIG. 1 is a perspective view of a conventional gas valve.
Figure 2:
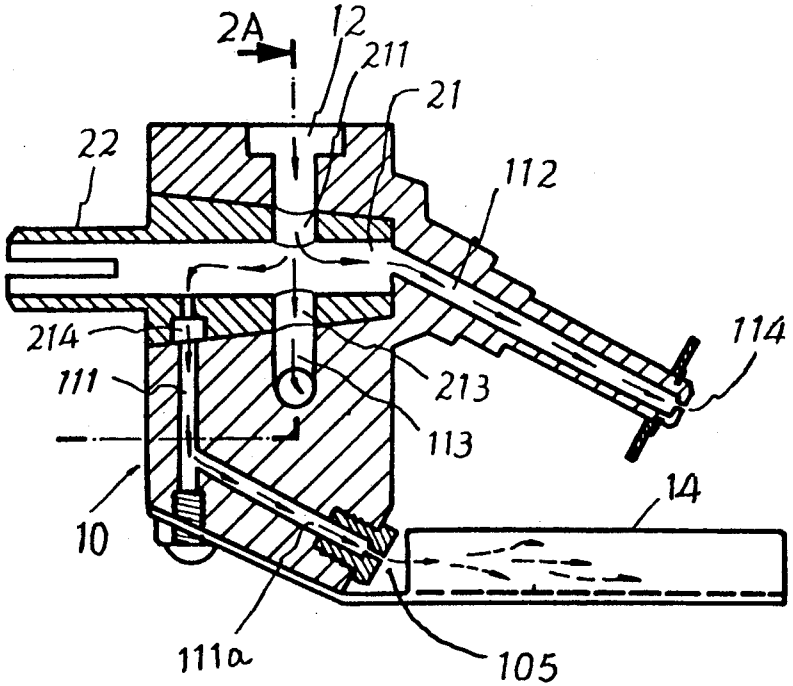
PRIOR ART FIG. 2
FIG. 2 is a sectional drawing of the conventional gas valve.
Figure 2A:
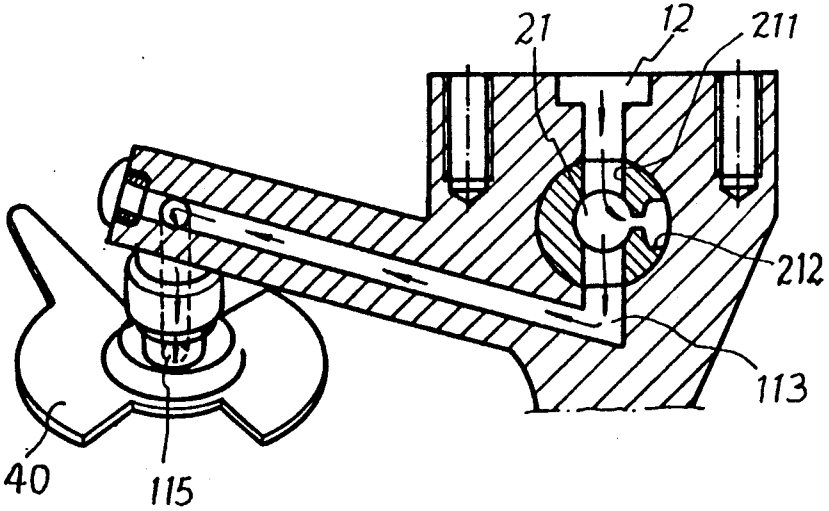
PRIOR ART FIG. 2A
FIG. 2A is a sectional view of the conventional gas valve when viewed from direction 2A of the FIG. 2.

The basic elements of the present invention are similar to a conventional gas valve as aforesaid and as shown in FIGS. 1–2A.

Figure 3:
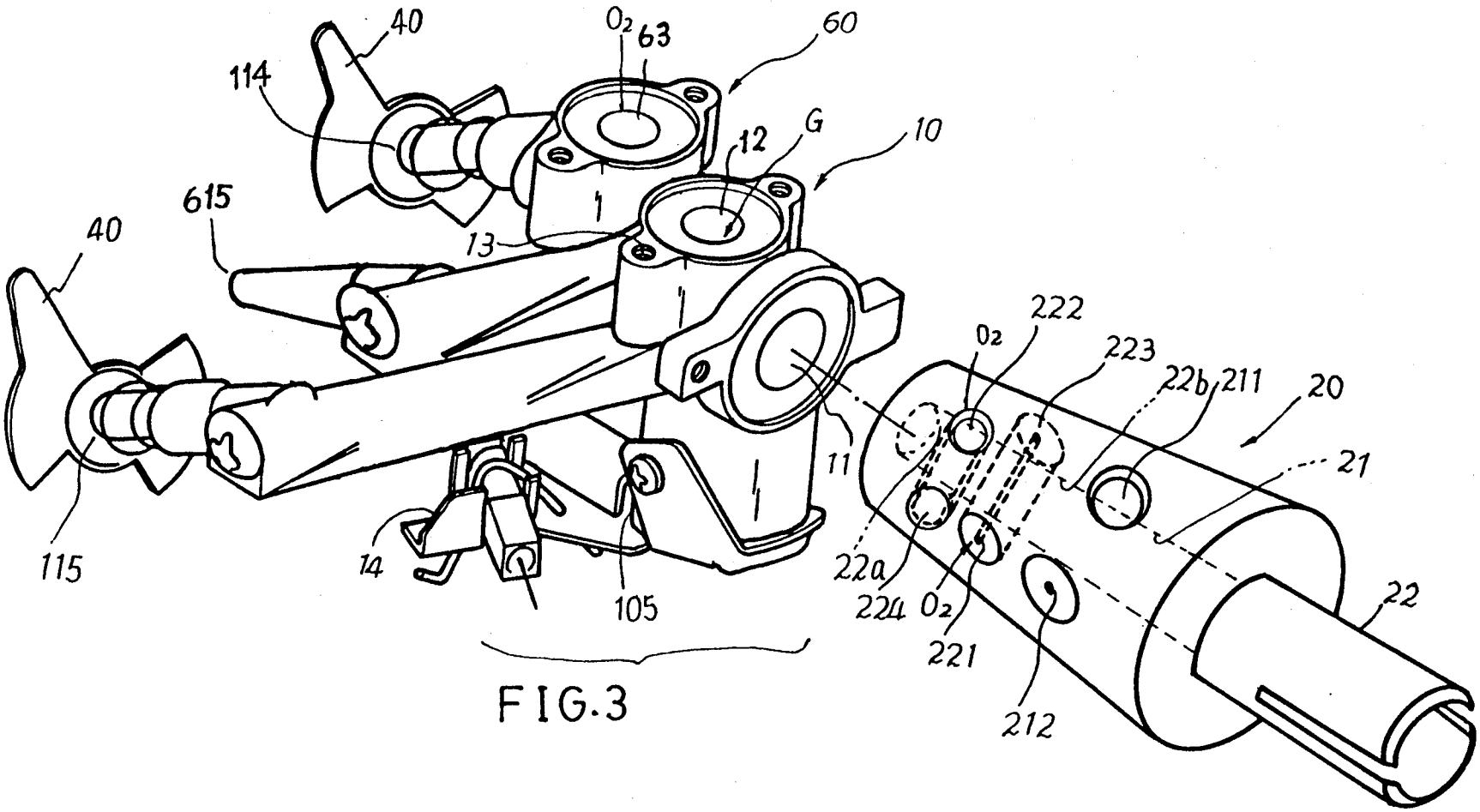
FIG. 3 is a perspective view of the drawing in which the rotor plug is enlarged.
Figure 4:
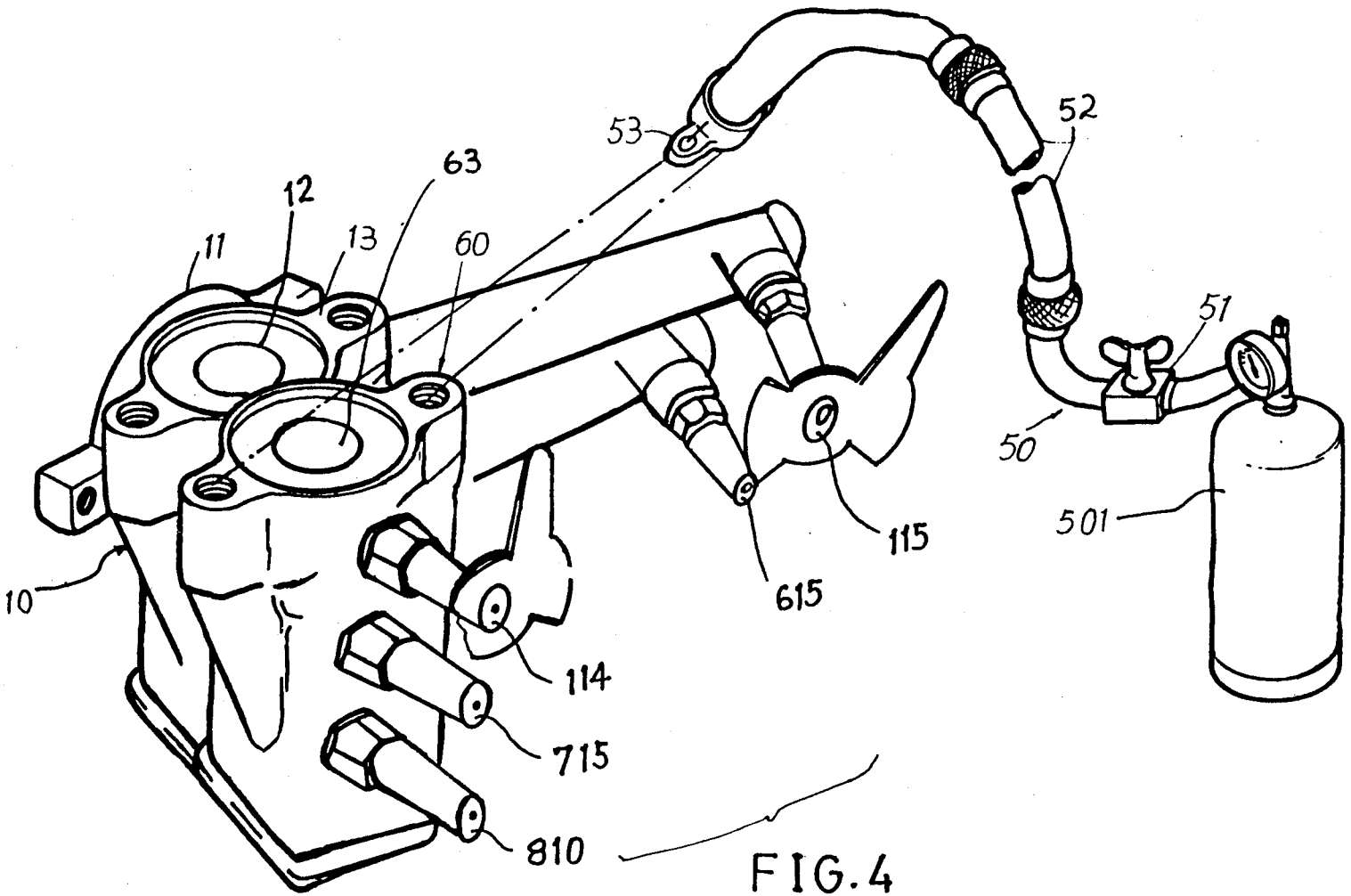
FIG. 4 is another perspective view of the present invention viewed from a rear side of FIG. 3 added with an oxygen supply system.

As shown in FIG. 3, the rotor plug 20 as aforesaid is extended to increase its length for providing oxygen openings in the plug 20 and an oxygen adapter base 60 is provided on the valve body 10 for connecting an oxygen adapter 53 of an oxygen supply system 50 as shown in FIG. 4 of which the oxygen supply system 50 includes an oxygen source or oxygen cylinder 501, a pressure regulator 51, and a gas tube 52 or hose which may be further connected with multiple-pass branches for other oxygen uses.

The oxygen gas $O_2$ is directed into the valve body 10 of a gas valve means of a gas oven through an oxygen inlet port 63 formed in the valve body 10 adjacent to the oxygen adapter base 60, and juxtapositional to the gas inlet port 12 also formed in the valve body 10.

The rotor plug 20 generally cylindrical shaped is formed with a larger oxygen inlet opening 222 in an inner perimeter of the plug longitudinally projectively aligned with the large gas inlet opening 211 formed in an outer perimeter of the plug 20, a large oxygen outlet opening 224 formed in an inner perimeter of the plug 20 opposite to the large oxygen inlet opening 222 having a large hollow oxygen tube 22*a* connecting the large oxygen inlet and outlet openings 222, 224 poking through the central longitudinal hole 21 longitudinally formed in the rotor plug 20, a small oxygen inlet opening 221 formed in a middle perimeter of the plug 20 longitudinally projectively aligned with the small oxygen inlet opening 221 formed in an outer perimeter of the plug 20, and a small oxygen outlet opening 223 formed in a middle perimeter of the plug 20 opposite to the small oxygen inlet opening 221 having a small hollow oxygen tube 22*b* connecting the small oxygen inlet and outlet openings 221, 223 poking through the central longitudinal hole 21.

When the rotor plug 20 is rotated to direct gas G through the gas port 12 into the large gas opening 211, the oxygen gas $O_2$ is inport into the valve means through the large oxygen opening 222; whereas if the gas is input the small gas opening 212, the oxygen will be fed into small oxygen opening 221 (FIG. 3). Each hollow tube 22*a* or 22*b* is not communicated with hole 21 to prevent unexpected mixing or burning of fuel gas with oxygen in the valve body 10.

A diameter of the hollow tube 22*a* or 22*b* should be smaller than a diameter of the central longitudinal hole 21 of the rotor plug 20 to prevent clogging of gas passage.

Figure 5:
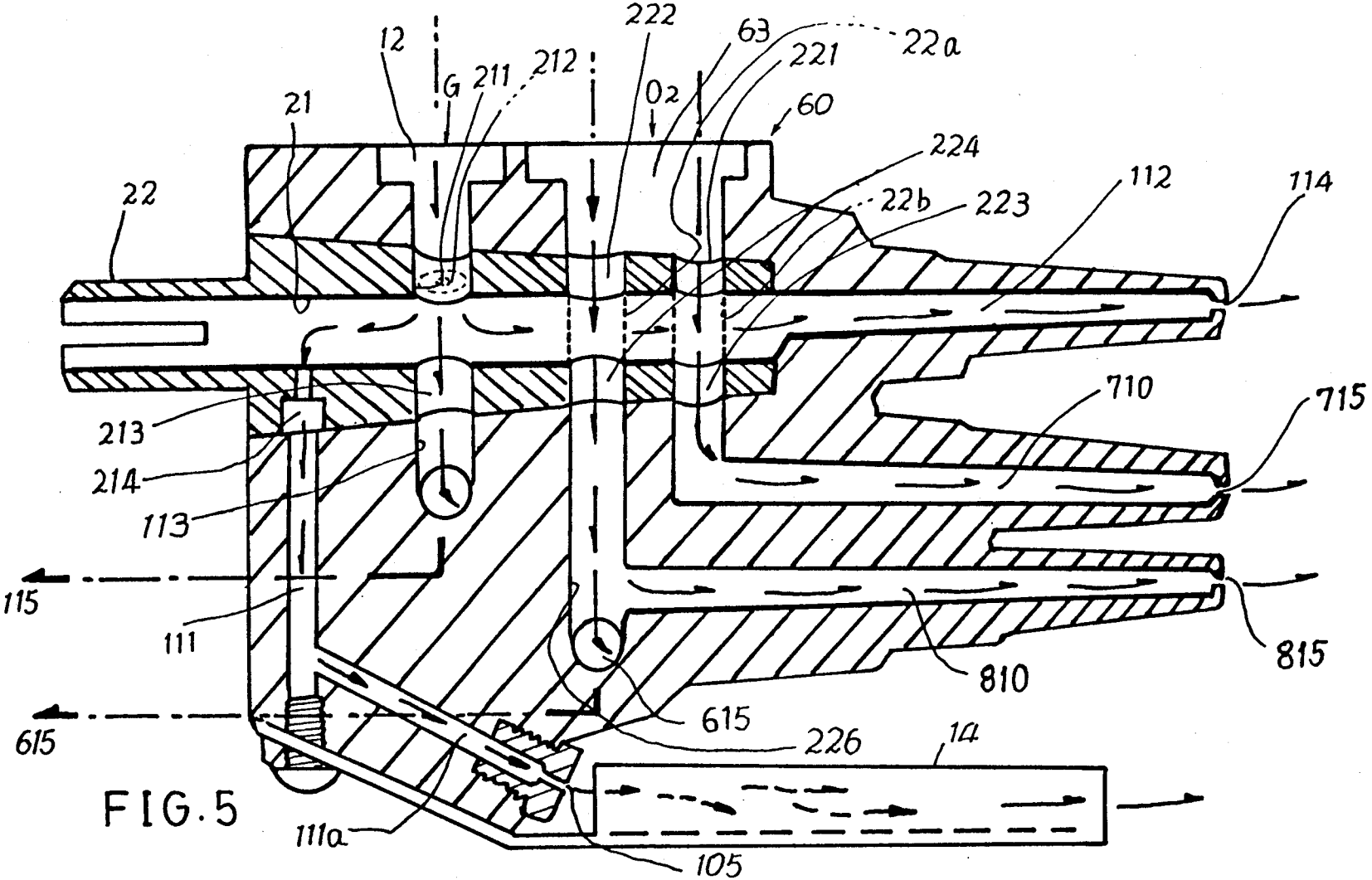
FIG. 5 is a sectional drawing of FIG. 4 in accordance with the present invention.

When the rotor plug 20 is rotated to match the large gas inlet opening 211 with the gas inlet port 12 to feed full gas G into the valve means of the present invention, the gas stream will flow into the central longitudinal hole 21 to distribute into the first gas passage 113 through outlet opening 213 as shown in FIG. 5 to an outer large nozzle 115 of the gas burner, and into the second gas passage 112 to an inner small nozzle 114 of the gas burner and a pilot gas stream flowing into the pilot gas passage 111, 111*a* to a pilot nozzle 105 to be ingited by the ingiting means 14.

Since the large oxygen inlet opening 222 is projectively aligned with the large gas inlet opening 211, the oxygen $O_2$ will be led into the oxygen opening through the inlet port 63, through the large hollow oxygen tube 22*a*, a large oxygen passage 226 formed in the valve body 10 to be distributed to a large oxygen nozzle 615 adjacent to the large gas nozzle 115 for helping a complete gas combustion at the large gas nozzle 115, and also distributed to a first small oxygen nozzle 815 through a by-pass oxygen passage 810 branched from the large oxygen passage 26 to be adjacent to the small gas nozzle 114 for helping a complete gas combustion at the small gas nozzle 114.

When the rotor plug 20 is rotated to match the small gas opening 212 with the gas port 12 to lead fuel gas G into the valve means, the fuel gas will enter the central hole 21 through the second gas passage 112 to the small gas nozzle 114 and the large gas outlet opening 213 is rotated to deviate from the gas passage 113 thereby closing the large gas nozzle 115 for causing a smaller flame burned at the small nozzle 114.

Since the small oxygen opening 221 is projectively aligned with the small gas opening 212, the oxygen will be fed into the opening 221 through the oxygen port 63, through the small hollow oxygen tube 22*b*, a small oxygen passage 710 formed in the valve body 10 to be distributed to a second small oxygen nozzle 715 adjacent to the small gas nozzle 114 for helping a complete gas combustion at the small gas nozzle 114.

All the oxygen streams are respectively mixed with the fuel gas streams after being discharged from the relevant nozzles so that the oxygen assists the combustion of fuel gas under an atmospheric pressure, rather than in any fluid passage in the valve body 10, thereby preventing unexpected "back fire" or explosion caused in a closed "chamber".

Since an additional combustion aid such as oxygen gas is provided to help the combustion of the fuel gas of the gas oven, the present invention may prevent an incomplete gas combustion and prevent the production of poisonous, hazardous carbon monoxide and pollutants such as carbon black.

The oxygen tube 52 of the oxygen supply system 50 may be further connected with multiple-pass branches (not shown) of which one branch is provided with a valve having a timer for periodically supplying oxygen into a room interior for refreshing air for people's breathing purpose; or another branch is provided with a mask adapted for a patient's emergency breathing for first aid purpose.

I claim:

1. A gas oven comprising: a gas valve means formed in the gas oven for controlling a flow rate of fuel gas from a fuel gas source to a fuel gas burner by leading a fuel gas stream through said gas valve means; and an oxygen supply system supplying oxygen fluid led through said gas valve means parallelly flowing towards the fuel gas burner as controlled by said gas valve means for helping a complete combustion of the fuel gas at the gas burner;

said gas valve means including a valve body having a gas inlet port vertically formed in a gas tube adapter for directing fuel gas into the port, a rotor plug hole horizontally formed in the valve body perpendicularly communicating the gas inlet port for rotatably engaging a rotor plug in the hole, and a rotating knob secured with the rotor plug rotatably mounted on the gas oven for operating the rotor plug for adjusting gas flow rate to a burning nozzle of the oven;

said rotor plug having a stem secured to a knob and a plug portion formed with a central longitudinal hole about a longitudinal axis of the plug, a large gas inlet opening radially formed through a cross section of the plug perpendicularly intersecting and communicating the central longitudinal hole having a large gas outlet opening formed in an opposite end of the inlet opening on a perimeter of the plug communicating with a first gas passage formed in the valve body to be finally connected with an outer large gas nozzle of the gas burner, a small gas inlet opening radially formed in the plug to be angularly separated from the large opening along a cross sectional plane perpendicular to the longitudinal axis and communicating with the central longitudinal hole and communicating a second gas passage formed in the valve body to be finally connected with an inner small gas nozzle of the gas burner, and a pilot gas outlet opening formed in an outer portion of the plug communicating with a pilot gas passage formed in the valve body to be finally communicated with a pilot gas nozzle for discharging pilot gas to be ignited by an igniting means secured to the valve body; and an oxygen passage means formed in said valve body; and said oxygen passage means including: an oxygen adapter base provided on the valve body for connecting an oxygen adapter of said oxygen supply system including an oxygen source connected with an oxygen cylinder and a oxygen gas tube, and an oxygen inlet port formed in the valve body on the oxygen adapter base, juxtapositional to the gas inlet port formed in the valve body for directing oxygen into the valve means.

2. A gas oven according to claim 1, wherein said rotor plug generally cylindrical shaped is formed with a larger oxygen inlet opening in an inner perimeter of the plug longitudinally projectively aligned with the large gas inlet opening formed in an outer perimeter of the plug, a large oxygen outlet opening formed in an inner perimeter of the plug opposite to the large oxygen inlet opening having a large hollow oxygen tube connecting the large oxygen inlet and outlet openings poking through the central longitudinal hole longitudinally formed in the rotor plug, a small oxygen inlet opening formed in a middle perimeter of the plug longitudinally projectively aligned with the small oxygen inlet opening formed in an outer perimeter of the plug, and a small oxygen outlet opening formed in a middle perimeter of the plug opposite to the small oxygen inlet opening having a small hollow oxygen tube connecting the small oxygen inlet and outlet openings poking through the central longitudinal hole of the plug.

3. A gas oven according to claim 2, wherein each said hollow oxygen tube has a diameter smaller than a diameter of the central longitudinal hole of the rotor plug to prevent clogging of gas passage.

4. A gas oven according to claim 2, wherein a large oxygen passage is formed in the valve body to be distributed to a large oxygen nozzle adjacent to the large gas nozzle for helping a complete gas combustion at the large gas nozzle, and also distributed to a first small oxygen nozzle through a by-pass oxygen passage branched from the large oxygen passage to be adjacent to the small gas nozzle for helping a complete gas combustion at the small gas nozzle; said large oxygen passage communicating said large oxygen inlet and outlet openings formed in said rotor plug.

5. A gas oven according to claim 2, wherein a small oxygen passage is formed in the valve body to be distributed to a second small oxygen nozzle adjacent to the small gas nozzle for helping a complete gas combustion at the small gas nozzle; said small oxygen passage communicating said small oxygen inlet and outlet openings formed in said plug.

6. A gas oven according to claim 1, wherein said oxygen gas tube includes multiple-pass branches for supplying oxygen into a room interior through a first branch provided with timer thereon for refreshing air and a second branch connected with a mask adapted for a first-aid breathing purpose.

* * * * *